US006859221B2

(12) United States Patent
Gao et al.

(10) Patent No.: US 6,859,221 B2
(45) Date of Patent: Feb. 22, 2005

(54) PREVENTING CREASE FORMATION IN DONOR WEB IN DYE TRANSFER PRINTER THAT CAN CAUSE LINE ARTIFACT ON PRINT

(75) Inventors: Zhanjun J. Gao, Rochester, NY (US); Robert F. Mindler, Churchville, NY (US); John F. Corman, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 73 days.

(21) Appl. No.: 10/391,174

(22) Filed: Mar. 18, 2003

(65) Prior Publication Data

US 2004/0183888 A1 Sep. 23, 2004

(51) Int. Cl.[7] ..... B41J 17/28
(52) U.S. Cl. ..... 347/217; 347/216; 347/103
(58) Field of Search ..... 347/217, 216, 347/218, 103, 101, 102; 400/234, 240, 237, 240.4

(56) References Cited

U.S. PATENT DOCUMENTS 5,979,731 A * 11/1999 Long et al. ..... 226/7
6,380,964 B1 * 4/2002 Tanaka ..... 347/217
6,724,412 B1 * 4/2004 Mindler et al. ..... 347/216
6,757,003 B1 * 6/2004 Gao et al. ..... 347/220
2001/0046401 A1 * 11/2001 Lien et al. ..... 400/240

* cited by examiner

*Primary Examiner*—Manish Shah
(74) *Attorney, Agent, or Firm*—Roger A. Fields

(57) ABSTRACT

A thermal printer capable of preventing crease formation in a dye transfer area of a dye donor web that can cause a line artifact to be printed on a dye receiver during a dye transfer from the dye transfer area to the dye receiver, includes a print head having a bead of selectively heated resistive elements that make contact across the dye transfer area of the dye donor web and opposite edge areas of the dye donor web that are alongside the dye transfer area as the dye transfer area and the edge areas are progressively advanced under a longitudinal tension over the bead of resistive elements. Also, a control is adapted to selectively heat those resistive elements that make contact with the dye transfer area to effect a dye transfer from the dye transfer area to a dye receiver, and adapted to variably heat those resistive elements that make contact with the edge areas alongside the dye transfer area to effect a gradual drop in heat substantially from respective boundaries between the dye transfer area and the edge areas to an outer edge of each edge area that is spaced from the dye transfer area. As a result, when the heated transfer area and edge areas are subjected to a longitudinal tension, a relative resistance to being stretched will steadily increase towards each outer edge to maintain strength at each outer edge, but to avoid a sharp transition at the boundaries in order to prevent crease formation that can cause a line artifact.

12 Claims, 8 Drawing Sheets

1

PREVENTING CREASE FORMATION IN DONOR WEB IN DYE TRANSFER PRINTER THAT CAN CAUSE LINE ARTIFACT ON PRINT

CROSS REFERENCE TO RELATED APPLICATION

Reference is made to commonly assigned co-pending application Ser. No. 10/242,241 entitled PREVENTING CREASE FORMATION IN DONOR WEB IN DYE TRANSFER PRINTER THAT CAN CAUSE LINE ARTIFACT ON PRINT, and filed Sep. 12, 2002 in the name of Terrence L. Fisher.

FIELD OF THE INVENTION

The invention relates generally to dye transfer printers such as thermal printers, and in particular to the problem of crease or wrinkle formation in successive dye transfer areas of the donor web. Crease formation in the dye transfer area can result in an undesirable line artifact being printed on a dye receiver.

BACKGROUND OF THE INVENTION

A typical multi-color dye donor web that is used in a thermal printer is substantially thin and has a repeating series of three different rectangular-shaped color sections or patches such as a yellow color section, a magenta color section and a cyan color section. Also, there may be a transparent colorless laminating section immediately after the cyan color section.

Each color section of the dye donor web consists of a dye transfer area that is used for dye transfer printing and a pair of opposite longitudinal edge areas alongside the dye transfer area which are not used for printing. The dye transfer area is about 95% of the web width and the two edge areas are each about 2.5% of the web width.

To make a multi-color image print using a thermal printer, a motorized donor take-up spool pulls the dye donor web from a donor supply spool in order to successively advance an unused single series of yellow, magenta and cyan color sections over a stationary bead of selectively heated resistive elements on a print head between the two spools. Respective color dyes within the yellow, magenta and cyan color sections are successively heat-transferred via the bead of selectively heated resistive elements, in superimposed relation, onto a dye receiver such as a paper or transparency sheet or roll, to form the color image print. The bead of resistive elements extends across the entire width of a color section, i.e. across its dye transfer area and its two edge areas alongside the transfer area. However, only those resistive elements that contact the dye transfer area are selectively heated. Those resistive elements that contact the two edge areas are not heated. In other words, the dye transfer is effected from the transfer area to the receiver medium, but not from the two edge areas to the receiver medium.

As each color section, including its dye transfer area and its two edge areas, is advanced over the bead of selectively heated resistive elements, the color section is subjected to a longitudinal tension particularly by the pulling force of the donor take-up spool. Since the dye transfer area is heated by the resistive elements, but the two edge areas alongside the transfer area are not, the transfer area is significantly weakened in relation to the edge areas. Consequently, the longitudinal tension will stretch the dye transfer area relative to the two edge areas. This stretching causes the dye transfer area to become thinner than the non-stretched edge areas, which in turn causes creases or wrinkles to develop in the transfer area, particularly in those regions of the transfer area that are close to the edge areas. The longitudinal creases or wrinkles are most notable in the regions of the dye transfer area that are close to the two edge areas because of the sharp, i.e. abrupt, transition between the weakened transfer area and the stronger edge areas.

As the donor web is advanced, the creases or wrinkles tend to spread or extend from a trailing or rear end portion of a used dye transfer area at least to a leading or front end portion of the next dye transfer area to be used. A problem that can result is that a crease or wrinkle in the leading or front end portion of the next dye transfer area to be used will cause an undesirable line artifact to be printed on a leading or front end portion of the dye receiver when dye transfer occurs at the crease. The line artifact printed on the dye receiver is relatively short, but quite visible.

The question presented therefore is how to solve the problem of the creases or wrinkles being created in an unused transfer area so that no line artifacts are printed on the dye receiver.

The Cross-Referenced Application

The cross-referenced application discloses a method of equalizing web-stretching caused by web tensioning in a dye transfer printer that is for use with a donor web having a dye transfer area and opposite longitudinal edge areas alongside the transfer area. The method includes the steps of heating a dye transfer area to effect a dye transfer from the transfer area to a dye receiver, and uniformly heating the two edge areas alongside the transfer area less than the transfer area is heated, but sufficiently so that the edge areas may be stretched by tension substantially the same as the transfer area may be stretched. If the two edge areas alongside a dye transfer area being used in the printer are stretched substantially the same as the dye transfer area, the likelihood of any creases or wrinkles being created in the next unused transfer area is substantially reduced. Thus, no line artifacts will be printed on a dye receiver in the printer.

SUMMARY OF THE INVENTION

According to one aspect of the invention, a method of preventing crease formation in a dye transfer area of a dye donor web that can cause a line artifact to be printed on a dye receiver during a dye transfer from the dye transfer area to the dye receiver in a dye transfer printer, comprises:

- heating the dye transfer area of the dye donor web to effect a dye transfer from the dye transfer area to a dye receiver; and
- heating opposite edge areas of the dye donor web alongside the dye transfer area, but with a gradual drop in heat substantially from respective boundaries between the dye transfer area and the edge areas to an outer edge of each edge area that is spaced from the dye transfer area, so that when the heated transfer area and edge areas are subjected to a longitudinal tension a relative resistance to being stretched will steadily increase towards each outer edge to maintain strength at each outer edge, but to avoid a sharp transition at the boundaries in order to prevent crease formation that can cause a line artifact.

In addition, the edge areas can be heated adjacent the boundaries at similar or different temperatures which are slightly lower than similar or different temperatures the dye transfer area is heated adjacent the boundaries, to effect only a slight temperature drop across the boundaries from the dye transfer area to the edge areas in order to begin the gradual drop in heat.

According to another aspect of the invention, a thermal printer capable of preventing crease formation in a dye transfer area of a dye donor web that can cause a line artifact to be printed on a dye receiver during a dye transfer from the dye transfer area to the dye receiver, comprises:

a print head having a bead of selectively heated resistive elements that make contact across the dye transfer area of the dye donor web and opposite edge areas of the dye donor web that are alongside the dye transfer area as the dye transfer area and edge areas are progressively advanced under a longitudinal tension over the bead of resistive elements; and a control adapted to selectively heat those resistive elements that make contact with the dye transfer area to effect a dye transfer from the dye transfer area to a dye receiver, and adapted to variably heat those resistive elements that make contact with the edge areas alongside the dye transfer area to effect a gradual drop in heat substantially from respective boundaries between the dye transfer area and the edge areas to an outer edge of each edge area that is spaced from the dye transfer area, whereby when the heated transfer area and edge areas are subjected to a longitudinal tension a relative resistance to being stretched will steadily increase towards each outer edge to maintain strength at each outer edge, but to avoid a sharp transition at the boundaries in order to prevent crease formation that can cause a line artifact.

DETAILED DESCRIPTION OF THE INVENTION

Donor Web

Figure 1:
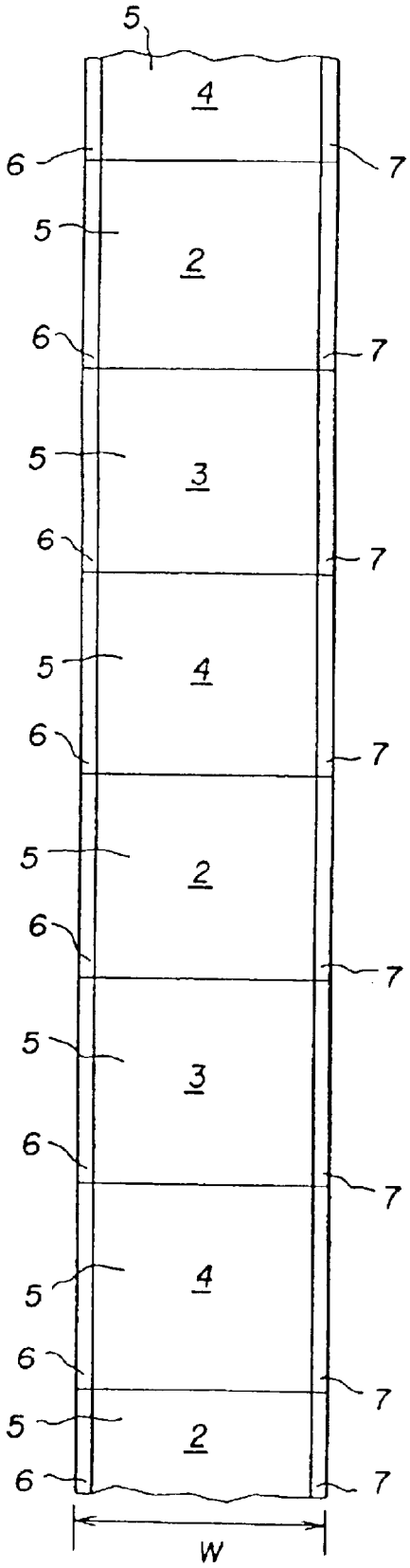
FIG. 1 is plan view of a typical donor web including successive dye transfer areas and opposite longitudinal edge areas alongside each one of the dye transfer areas.

FIG. 1 depicts a typical multi-color dye donor web or ink ribbon 1 that is used in a thermal printer. The donor web 1 is substantially thin and has a repeating series (only two completely shown) of three different rectangular-shaped color sections or patches such as a yellow color section 2, a magenta color section 3 and a cyan color section 4. Also, there may be a transparent laminating section (not shown) immediately after the cyan color section 4.

Each yellow, magenta or cyan color section 2, 3 and 4 of the dye donor web 1 consists of a yellow, magenta or cyan dye transfer area 5 that is used for printing and a pair of similar-colored opposite longitudinal edge areas 6 and 7 alongside the transfer area which are not used for printing. The dye transfer area 5 is about 95% of the web width W and the two edge areas 6 and 7 are each about 2.5% of the web width. See FIG. 1.

Dye Transfer Printer

FIGS. 2–6 depict operation of a thermal printer 10 using the dye donor web 1 to effect successive yellow, magenta and cyan dye transfers, in superimposed relation, onto a known dye receiver sheet 12 such as paper or a transparency.

Initialization

Figure 2:
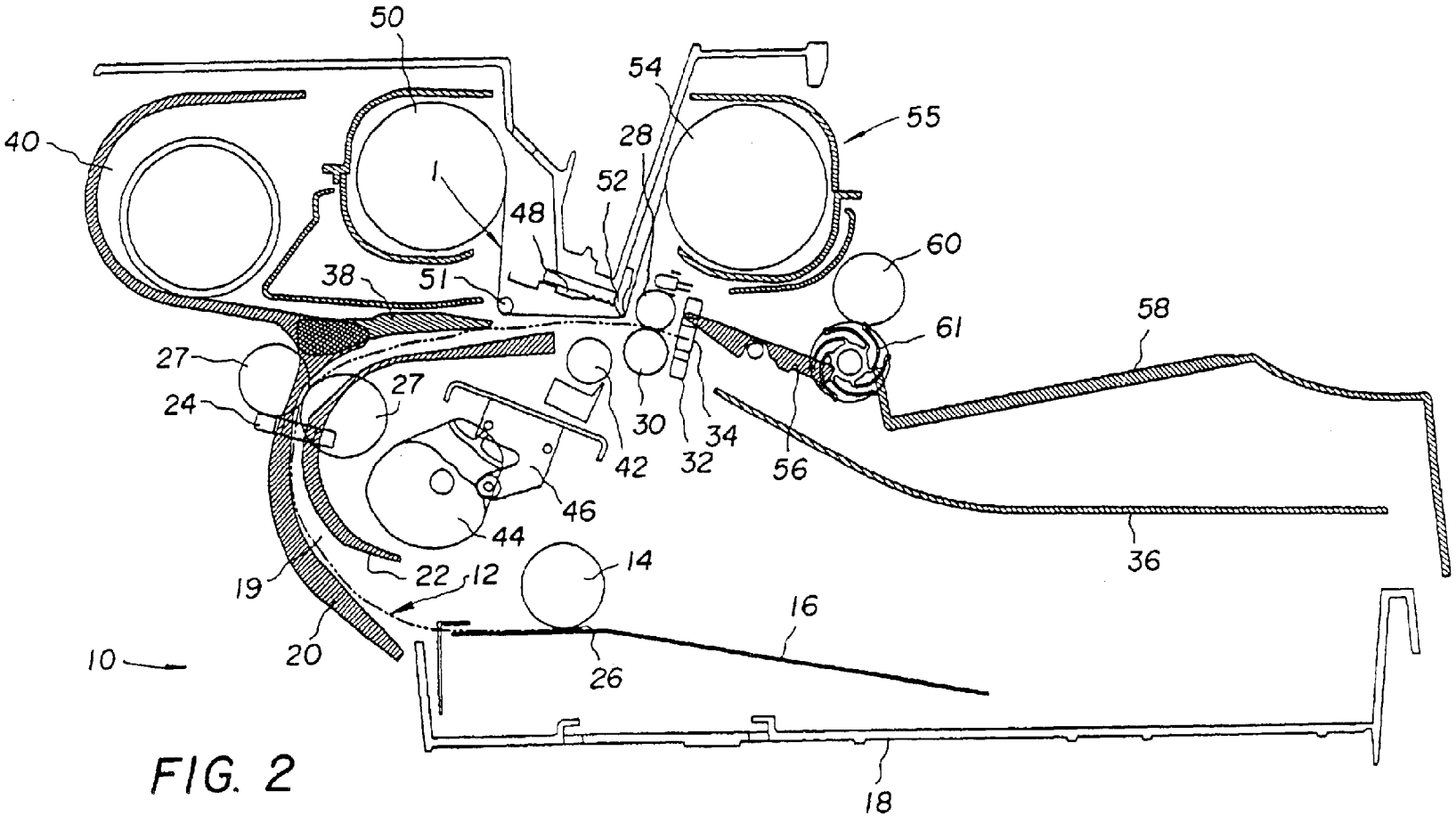
FIG. 2 is an elevation section view, partly in section, of a dye transfer printer, showing a beginning or initialization cycle during a printer operation.

Beginning with FIG. 2, the dye receiver sheet 12 is initially advanced forward via motorized coaxial pick rollers 14 (only one shown) off a floating platen 16 in a tray 18 and into a channel 19 defined by a pair of curved longitudinal guides 20 and 22. When a trailing (rear) edge sensor 24 midway in the channel 19 senses a trailing or rear edge 26 of the receiver sheet 12, it activates at least one of pair of motorized parallel-axis urge rollers 27, 27 in the channel 19. The activated rollers 27, 27 advance the receiver sheet 12 forward (to the right in FIG. 2) through the nip of a motorized capstan roller 28 and a pinch roller 30, positioned beyond the channel 19, and to a leading (front) edge sensor 32.

Figure 3:
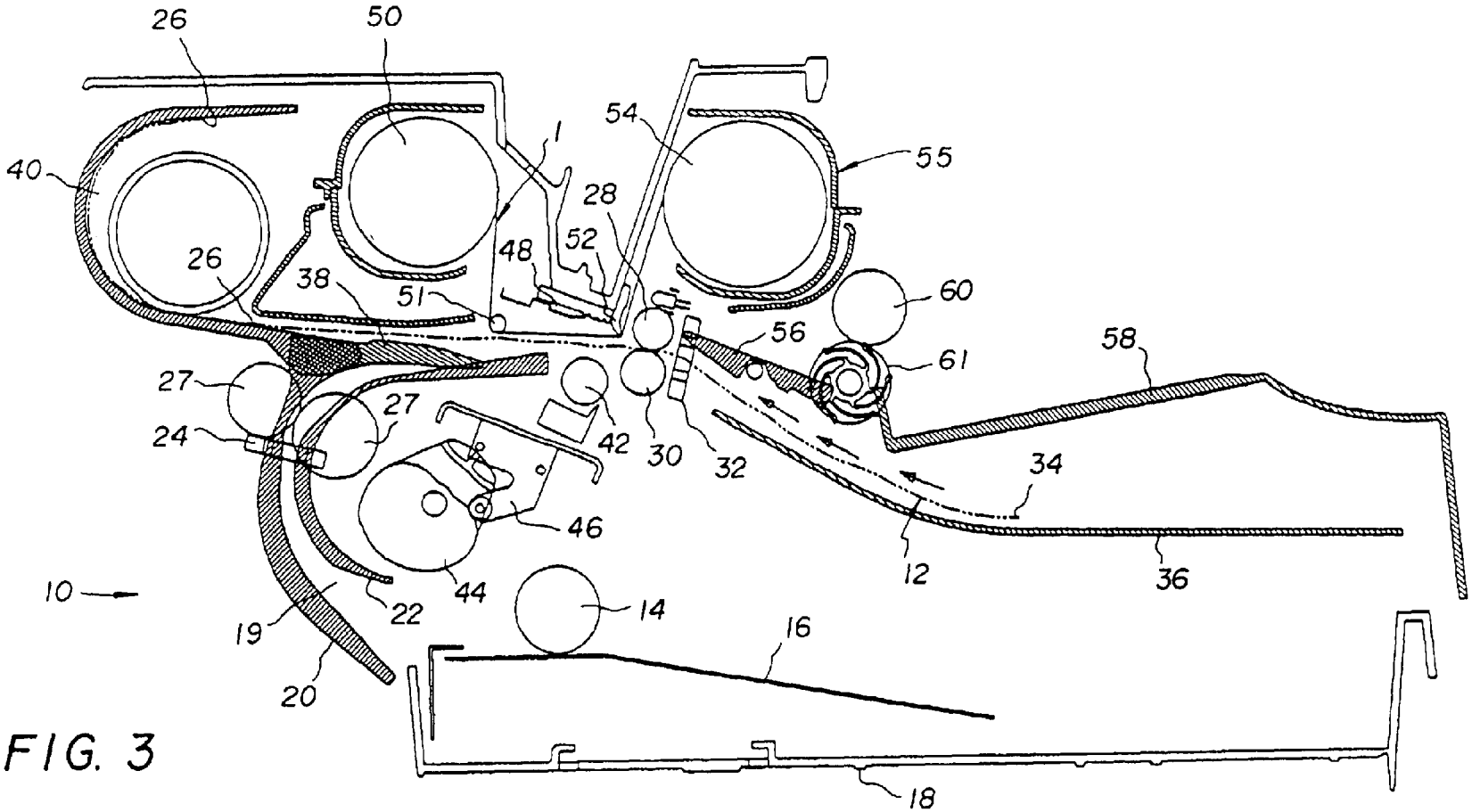
FIGS. 3 and 4 are elevation section views of the dye transfer printer as in FIG. 2, showing dye transfer cycles during the printer operation.

In FIG. 3, the leading edge sensor 32 has sensed a leading or front edge 34 of the dye receiver sheet 12 and activated the motorized capstan roller 28 to cause that roller and the pinch roller 30 to advance the receiver sheet forward partially onto an intermediate tray 36. The receiver sheet 12 is advanced forward onto the intermediate tray 36 so that the trailing or rear edge 26 of the receiver sheet can be moved beyond a hinged exit door 38 which is a longitudinal extension of the curved guide 20. Then, as illustrated, the hinged exit door 38 closes and the capstan and pinch rollers 28 and 30 are reversed to advance the receiver sheet 12 rearward, i.e. rear edge 26 first, partially into a rewind chamber 40.

Successive Yellow, Magenta and Cyan Dye Transfers

To make a multi-color image print, respective color dyes in the dye transfer areas 5 of a single series of yellow, magenta and cyan color sections 2, 3 and 4 on the donor web 1 must be successively heat-transferred in superimposed relation onto the dye receiver sheet 12. This is shown beginning in FIG. 4.

Figure 4:
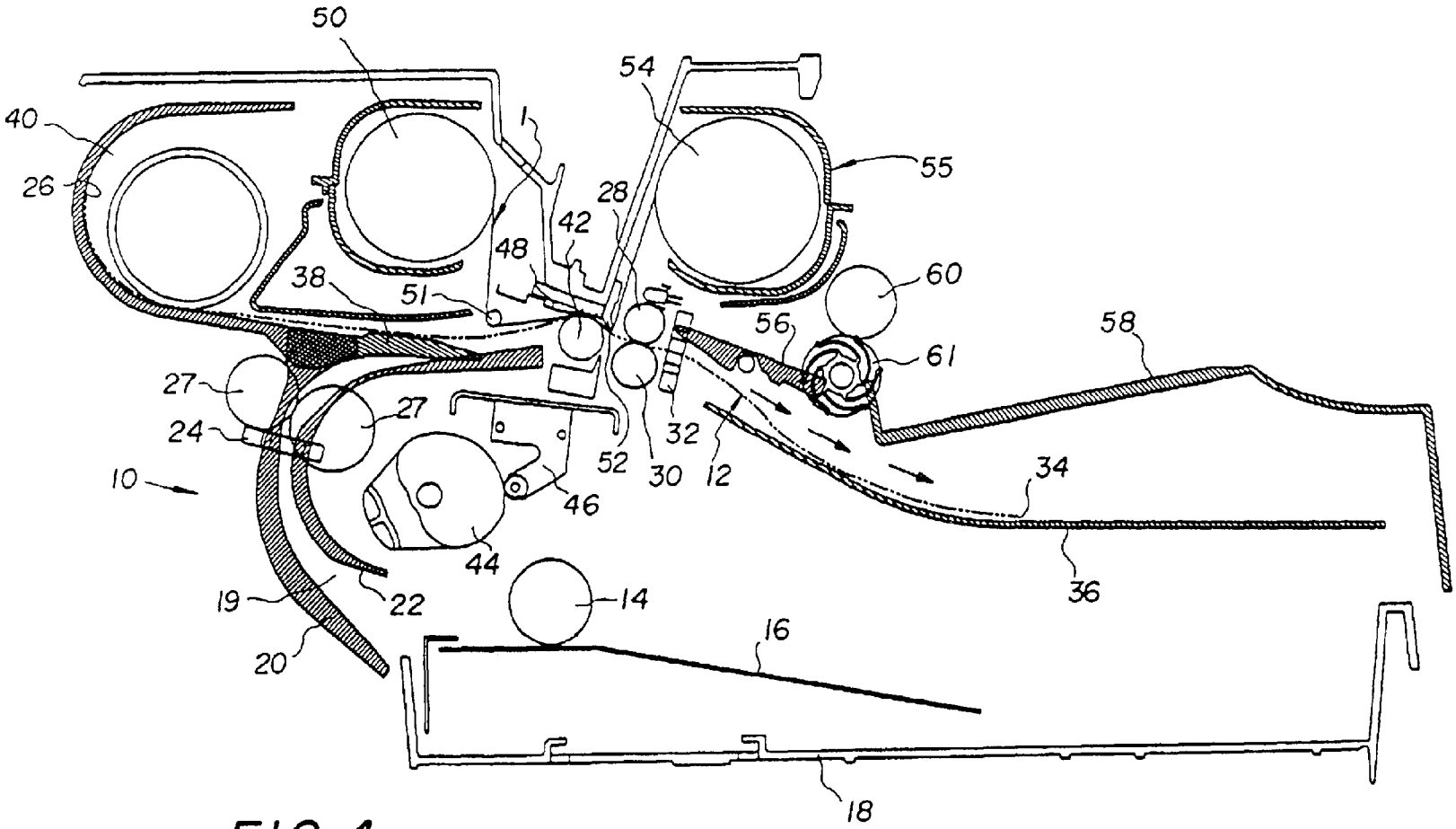

In FIG. 4, a platen roller 42 is shifted via a rotated cam 44 and a platen lift 46 to adjacent a thermal print head 48. This causes the dye receiver sheet 12 and an unused (fresh) yellow color section 2 of the donor web 1 to be locally held together between the platen roller 42 and the print head 48. The motorized capstan roller 28 and the pinch roller 30 are reversed to again advance the dye receiver sheet 12 forward to begin to return the receiver sheet to the intermediate tray 36. At the same time, the donor web 1 is advanced forward under a longitudinal tension, from a donor supply spool 50, over a first stationary web guide 51, the print head 48, and a second stationary web guide or guide nose 52. This is accomplished by a motorized donor take-up spool 54 that pulls or draws the donor web forward. The donor supply and take-up spools 50 and 54 together with the donor web 1 may be provided in a replaceable cartridge 55 that is loaded into the printer 10.

Figure 7:
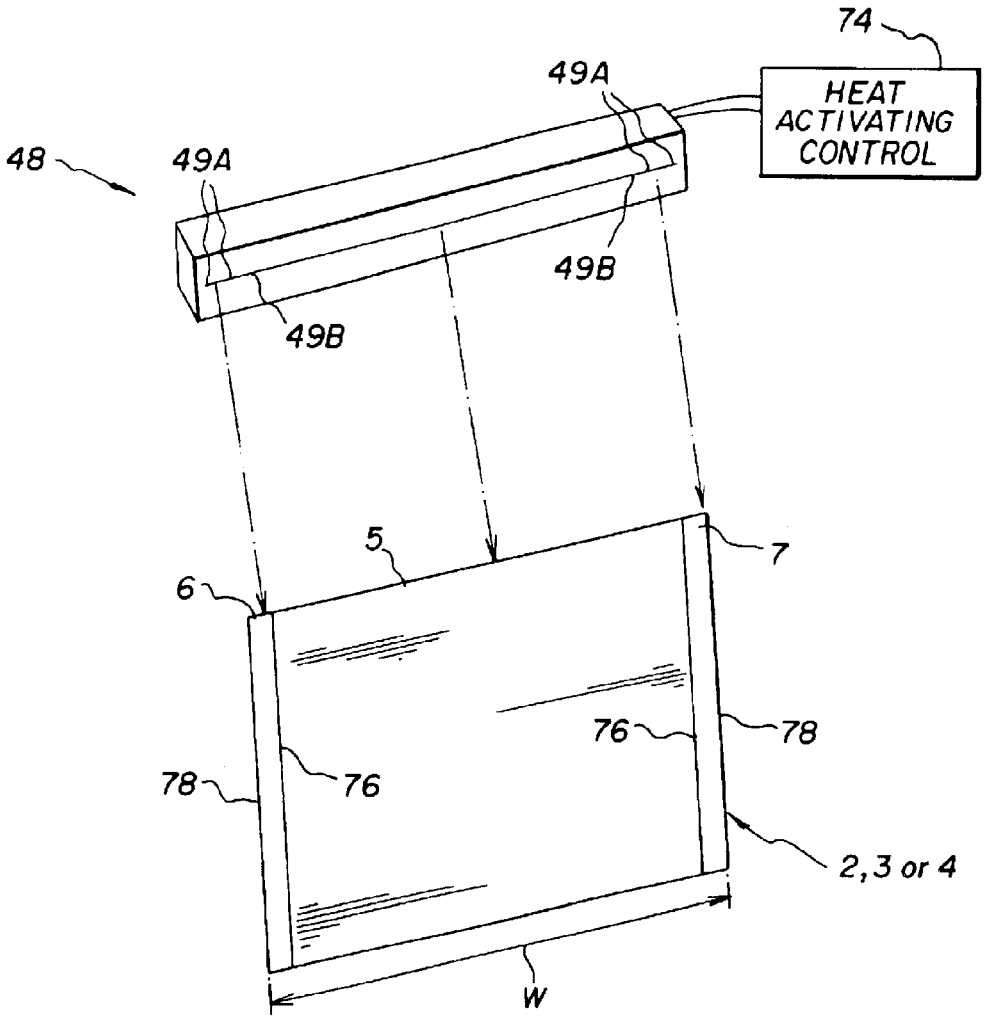
FIG. 7 is a perspective view showing a bead of selectively heated resistive elements on a print head in the dye transfer printer.

When the yellow color section 2 of the donor web 1 is moved forward over the print head 48 in FIG. 4, the yellow color dye in that color section is heat-transferred onto the dye receiver sheet 12. The yellow dye transfer is done line-by-line, i.e. row-by-row, widthwise across the yellow color section 2 via a bead of selectively heated resistive elements 49A, 49A, . . . 49B, 49B, . . . , 49A, 49A, . . . on the print head 48. See FIG. 7. The bead of selectively heated resistive elements 49A, 49A, . . . , 49B, 49B, . . . , 49A, 49A, . . . make contact across the entire width W of the yellow color section 2, i.e. across its dye transfer area 5 and its two edge areas 6 and 7 alongside the transfer area. As shown in FIG. 7, the resistive elements 49A makes contact with the edge areas 6 and 7 and the resistive elements 49B make contact with the dye transfer area 5.

Figure 5:
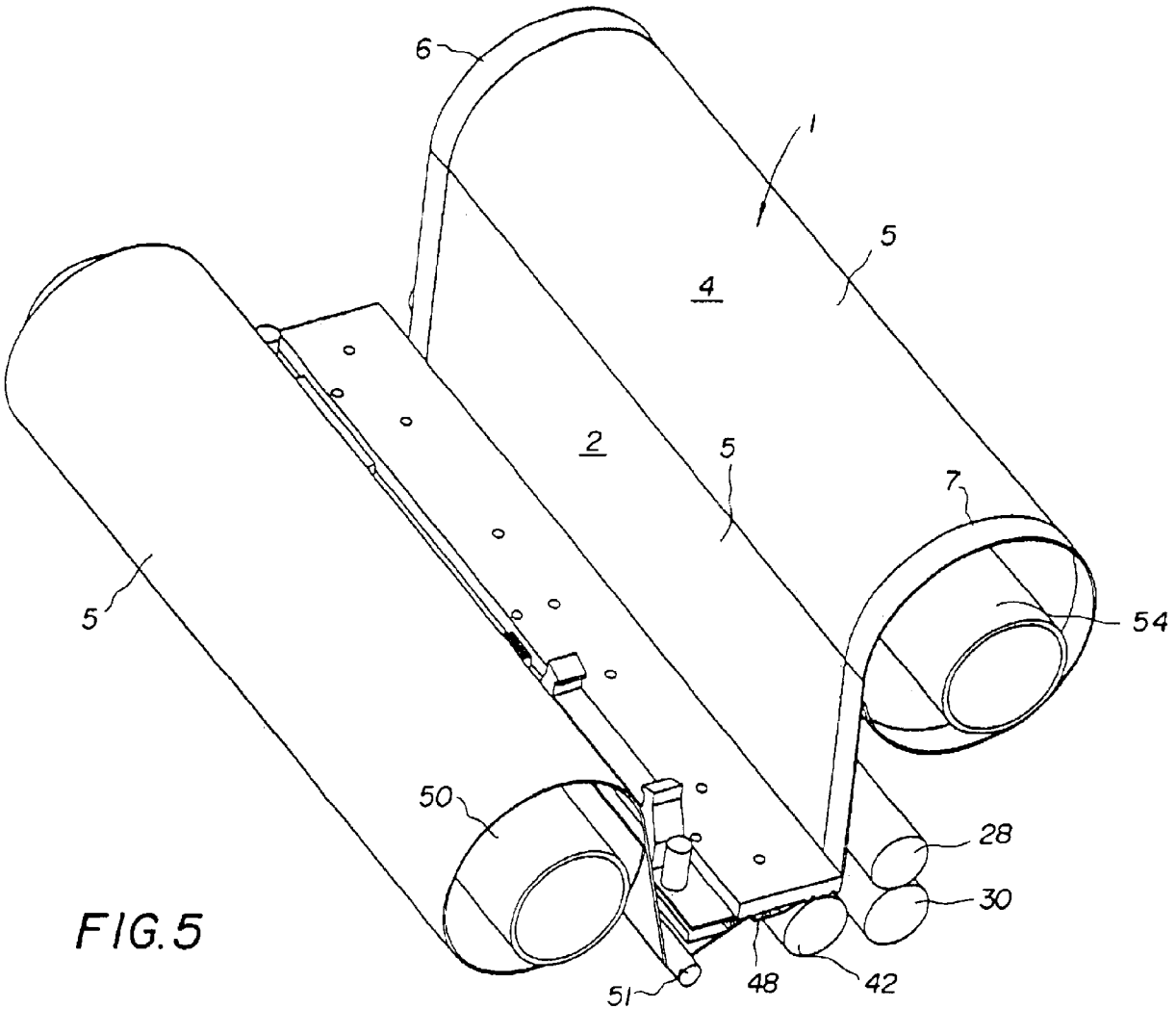
FIG. 5 is perspective view of a printing or dye transfer station in the dye transfer printer.

As the yellow color section 2 of the donor web 1 is used for dye transfer line-by-line, it moves forward from the print head 48 and over the guide nose 52 in FIGS. 4 and 5. Then, once the yellow dye transfer onto the dye receiver sheet 12 is completed, the platen roller 42 is shifted via the rotated cam 44 and the platen lift 46 from adjacent the print head 48 to separate the platen roller from the print head, and the motorized capstan 28 and the pinch roller 30 are reversed to advance the dye receiver sheet rearward, i.e. trailing or rear edge 26 first, partially into the rewind chamber 40. See FIG. 3.

Then, the dye transfer onto the dye receiver sheet 12 is repeated in FIG. 4, but this time using an unused (fresh) magenta color section 3 of the donor web 1 to heat-transfer the magenta color dye in that color section onto the dye receiver sheet. The magenta dye transfer is superimposed on the yellow dye transfer on the dye receiver sheet 12.

Once the magenta dye transfer onto the dye receiver sheet 12 is completed, the platen roller 42 is shifted via the rotated cam 44 and the platen lift 46 from adjacent the print head 48 to separate the platen roller from the print head, and the motorized capstan 28 and the pinch roller 30 are reversed to advance the dye receiver sheet rearward, i.e. trailing or rear edge 26 first, partially into the rewind chamber 40. See FIG. 3.

Then, the dye transfer onto the dye receiver sheet 12 is repeated in FIG. 4, but this time using an unused (fresh) cyan color section 3 of the donor web 1 to heat-transfer the cyan color dye in that color section onto the dye receiver sheet. The cyan dye transfer is superimposed on the magenta and yellow dye transfers on the dye receiver sheet 12.

Once the cyan dye transfer onto the dye receiver sheet 12 is completed, the platen roller 42 is shifted via the rotated cam 44 and the platen lift 46 from adjacent the print head 48 to separate the platen roller from the print head, and the motorized capstan roller 28 and the pinch roller 30 are reversed to advance the dye receiver sheet rearward, i.e. trailing or rear edge 26 first, partially into the rewind chamber 40. See FIG. 3.

Figure 6:
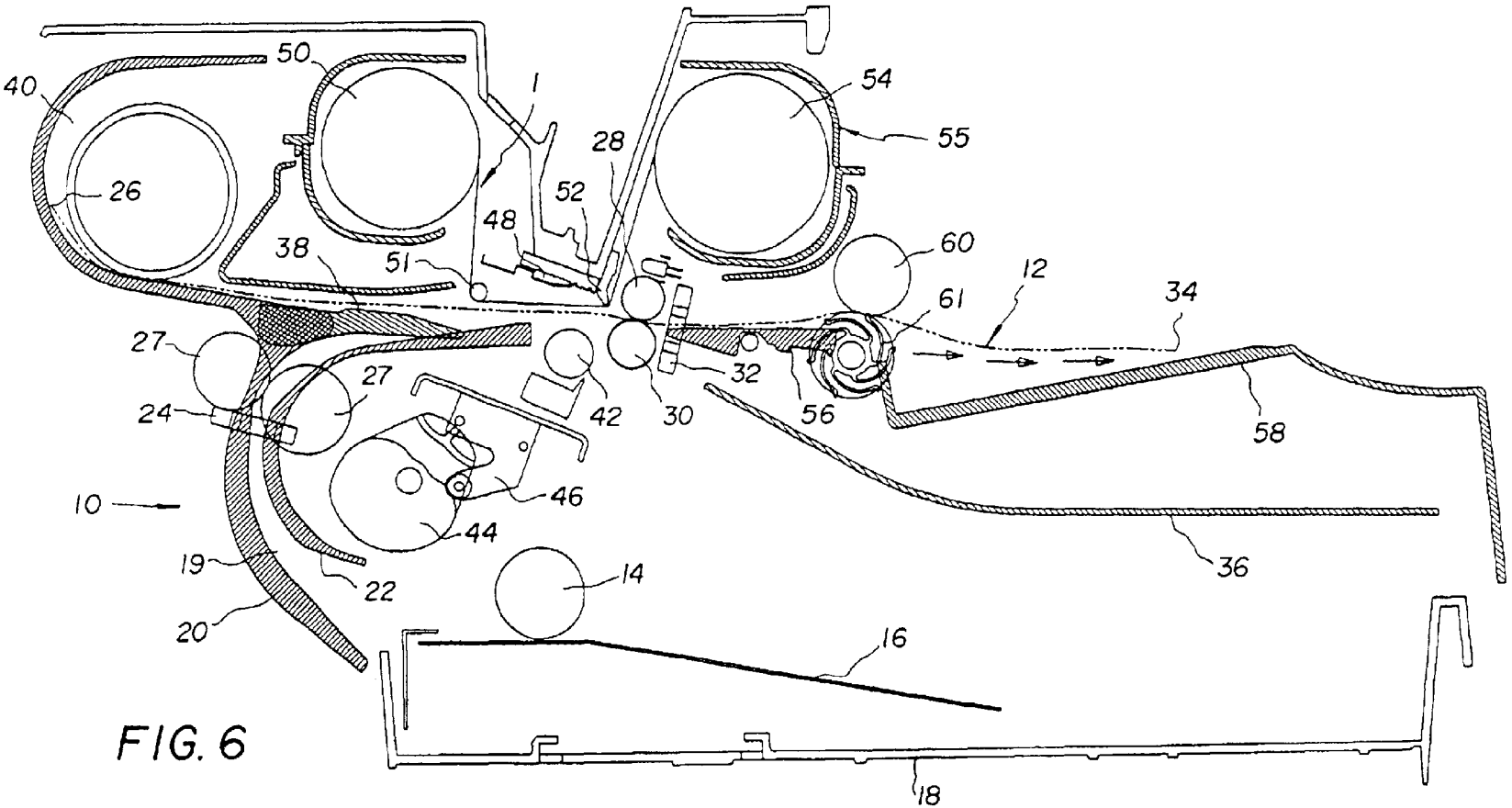
FIG. 6 is an elevation section view of the dye transfer printer as in FIG. 2, showing a final cycle during the printer operation.

Finally, as shown in FIG. 6, the platen roller 42 remains separated from the print head 48 and the motorized capstan roller 28 and the pinch roller 30 are reversed to advance the dye receiver sheet 12 forward. However, in this instance a diverter 56 is pivoted to divert the dye receiver sheet 12 to an exit tray 58 instead of returning the receiver sheet to the intermediate tray 36 as in FIG. 4. A pair of parallel axis exit rollers 60 and 62 aid in advancing the receiver sheet 12 into the exit tray 58.

Prior Art Problem

Figure 8:
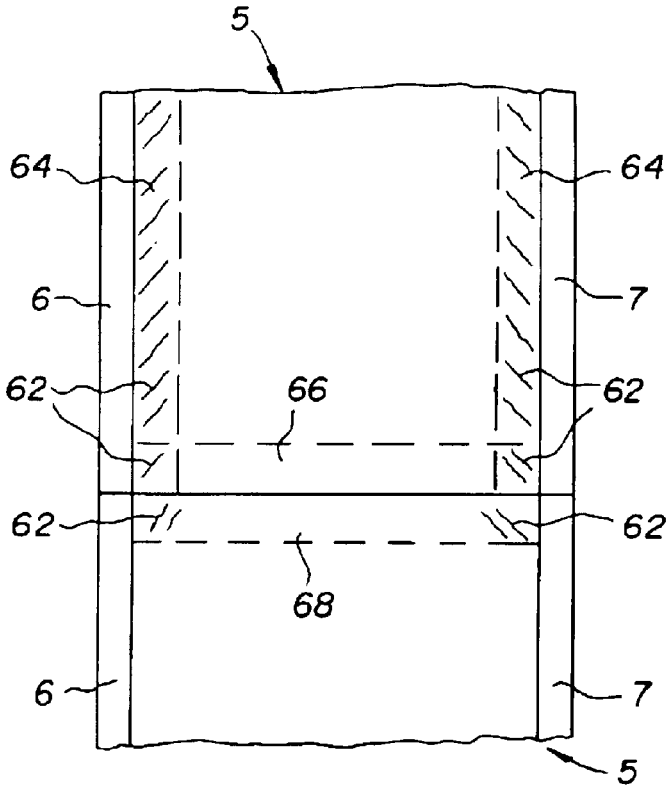
FIG. 8 PRIOR ART
FIG. 8 is a plan view of a portion of the donor web as in FIG. 1, showing creases or wrinkles spreading rearward from a trailing or rear end portion of a used transfer area into a leading or front end portion of an unused transfer area in the next (fresh) color section to be used, as in the prior art.

Typically in prior art dye transfer, as each yellow, magenta and cyan color section 2, 3 and 4, including its dye transfer area 5 and its two edge areas 6 and 7 , is advanced over the bead of selectively heated resistive elements 49A, 49A, . . . , 49, 49B, . . . , 49A, 49A, . . . , the color section is subjected to a longitudinal tension imposed substantially by the pulling force of the motorized donor take-up spool 54. Moreover, since the dye transfer area 5 is heated by the resistive elements 49B, but the two edge areas 6 and 7 alongside the transfer area are not heated by the resistive elements 49A, the dye transfer area is significantly weakened in relation to the edge areas. Consequently, the longitudinal tension will stretch the dye transfer area 5 relative to the two edge areas 6 and 7. This stretching causes the dye transfer area 5 to become thinner than the non-stretched edge areas 6 and 7, which in turn causes creases or wrinkles 62 to develop in the transfer area, particularly in those regions 64 of the transfer area that are close to the edge areas. See FIG. 8. The longitudinal creases or wrinkles 62 are most notable in the regions 64 of the dye transfer area 5 that are close to the two edge areas 6 and 7 because of the sharp, i.e. abrupt, transition between the weakened transfer area and the stronger edge areas.

As the dye donor web 1 is advanced, the creases or wrinkles 62 tend to spread or extend from a trailing or rear end portion 66 of a used dye transfer area 5 at least to a leading or front end portion 68 of the next dye transfer area to be used. In the leading or front end portion 68 of the next dye transfer area to be used, the creases or wrinkles 62 may become inclined. See FIG. 8. A problem that can result is that a crease or wrinkle 62 in the leading or front end portion 68 of the next dye transfer area 5 to be used will cause an undesirable line artifact 70 to be printed on a leading or front end portion 72 of the dye receiver sheet 12 when dye transfer occurs at the crease. See FIG. 9. The line artifact 70 printed on the dye receiver sheet 12 is relatively short, but quite visible, and may be inclined by as much as 45°.

Figure 9:
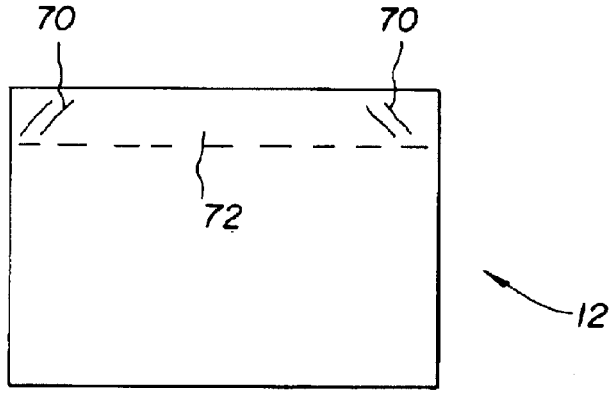
FIG. 9 PRIOR ART
FIG. 9 is a plan view of a dye receiver sheet, showing line artifacts printed on a leading or front edge portion of the dye receiver sheet, as in the prior art.

The question presented therefore is how to solve the problem of the creases or wrinkles 62 being created in an unused transfer area 5 so that no line artifacts 70 are printed on the dye receiver sheet 12 as in FIG. 9.

Solution

During successive yellow, magenta and cyan dye transfers onto the dye receiver sheet 12 in the thermal printer 10, the heated resistive elements 49B make contact across the dye transfer area 5 and the resistive elements 49A make contact across the edge areas 6 and 7 alongside the dye transfer area.

A known heat activating control 74, preferably including a suitably programmed microcomputer using known programming techniques, is connected individually to the resistive elements 49A, 49A, . . . , 49B, 49B, . . . , 49A, 49A, to selectively heat those resistive elements 49B that make contact with the dye transfer area 5 to effect a dye transfer from the dye transfer area to the dye receiver sheet 12. Moreover, the heat activating control 74 variably heats those resistive elements 49A that make contact with the edge areas 6 and 7 alongside the dye transfer area to effect a gradual drop in heat substantially from respective boundaries 76 between the dye transfer area and the edge areas to an outer edge 78 of each edge area that is spaced from the dye transfer area See FIG. 7

As a result, when the heated transfer area 5 and edge areas 6 and 7 alongside the transfer area are subjected to a longitudinal tension, a relative resistance to being stretched will steadily increase towards each outer edge 78 of the edge areas. This will maintain strength at each outer edge 78, i.e. the greatest resistance to being stretched by the tension will be at each outer edge. Also, the sharp temperature transition at the boundaries 76 as in the prior art will be avoided. Thus, none of the creases or wrinkles 62 will be created in an unused transfer area 5 as in FIG. 8, so that none of the line artifacts 70 will be printed on the dye receiver sheet 12 as in FIG. 9.

The control 74 heats those of the resistive elements 49A that make contact with the edge areas 6 and 7 adjacent the boundaries 76 slightly less than those of the resistive elements 49B that make contact with the dye transfer area 5 adjacent the boundaries. This is to effect only a slight drop in heat across the boundaries 76 from the dye transfer area 5 to the edge areas 6 and 7 in order to begin the gradual drop in heat to the outer edge 78 of each edge area 6 and 7.

Moreover, the gradual drop in heat from the boundaries 76 to the outer edge 78 of each edge area 6 and 7 preferably is a uniform or liner drop to above the ambient temperature at the outer edge of each edge area. However, the drop can be to within the range of 120° Fahrenheit–104° Fahrenheit at the outer edge 76 of each edge area 6 and 7.

The invention has been described in detail with particular reference to certain preferred embodiments thereof, but it will be understood that variations and modifications can be effected within the spirit and scope of the invention.

Parts list

1. donor web
2. cyan color section
3. magenta color section
4. yellow color section
5. dye transfer area
6. longitudinal edge area
7. longitudinal edge area
W. web width
10. thermal printer
12. dye receiver sheet
14. pick rollers
16. platen
18. tray
19. channel
20. longitudinal guide
22. longitudinal guide
24. trailing edge sensor
26. trailing edge
27. urge rollers
28. capstan roller
30. pinch roller
32. leading edge sensor
34. leading or front edge
36. intermediate tray
38. exit door
40. rewind chamber
42. platen roller
44. cam
46. platen lift
48. print head
49A, 49B. resistive elements
50. donor supply spool
51. first stationary (fixed) web guide
52. second stationary (fixed) web guide or guide nose
54. donor take-up spool
55. cartridge
56. diverter
58. exit tray
60. exit roller
61. exit roller
62. creases or wrinkles
64. regions
66. trailing or rear end portion
68. leading or front end portion
70. line artifacts
72. leading or front end portion
74. heat activating control
76. boundaries
78. outer edges

What is claimed is:

1. A method of preventing crease formation in a dye transfer area of a dye donor web that can cause a line artifact to be printed on a dye receiver during a dye transfer from the dye transfer area to the dye receiver in a dye transfer printer, said method comprising:

heating the dye transfer area of the dye donor web to effect a dye transfer from the dye transfer area to a dye receiver; and heating opposite edge areas of the dye donor web that are alongside the dye transfer area, but with a gradual drop in heat substantially from respective boundaries between the dye transfer area and the edge areas to an outer edge of each edge area that is spaced from the dye transfer area, so that when the heated transfer area and edge areas are subjected to a longitudinal tension a relative resistance to being stretched will steadily increase towards each outer edge to maintain strength at each outer edge, but to avoid a sharp transition at the boundaries in order to prevent crease formation that can cause a line artifact.

2. A method as recited in claim 1, wherein the gradual drop in heat from the boundaries between the dye transfer area and the edge areas to the outer edge of each edge area is a uniform drop.

3. A method as recited in claim 1, wherein the gradual drop in heat from the boundaries between the dye transfer area and the edge areas to the outer edge of each edge area is one to above the ambient temperature at the outer edge of each edge area.

4. A method as recited in claim 1, wherein the gradual drop in heat from the boundaries between the dye transfer area and the edge areas to the outer edge of each edge area is one to within the range of 104° Fahrenheit–120° Fahrenheit at the outer edge of each edge area.

5. A method as recited in claim 1, wherein the gradual drop in heat from the boundaries between the dye transfer area and the edge areas to the outer edge of each edge area is one to about 104° Fahrenheit at the outer edge of each edge area.

6. A method as recited in claim 1, wherein the edge areas are heated adjacent the boundaries at similar or different temperatures which are slightly lower than similar or different temperatures the dye transfer area is heated adjacent the boundaries to effect only a slight temperature drop across the boundaries from the dye transfer area to the edge areas in order to begin the gradual drop in heat.

7. A method as recited in claim 6, wherein the gradual drop in heat from the boundaries to the outer edge of each edge area is a linear drop.

8. A method of preventing crease formation in a dye transfer area of a dye donor web that can cause a line artifact to be printed on a dye receiver during a dye transfer from the dye transfer area to the dye receiver, in a dye transfer printer including a print head for effecting the dye transfer via a bead of selectively heated resistive elements that make contact across the dye transfer area and opposite edge areas of the dye donor web that are alongside the dye transfer area as the dye transfer area and the edge areas are progressively advanced under a longitudinal tension over the bead of resistive elements, said method comprising:

selectively heating those resistive elements that make contact with the dye transfer area to effect a dye transfer from the dye transfer area to a dye receiver; and variably heating those resistive elements that make contact with the edge areas alongside the dye transfer area to effect a gradual drop in heat substantially from respective boundaries between the dye transfer area and the edge areas to an outer edge of each edge area that is spaced from the dye transfer area, so that when the heated transfer area and edge areas are subjected to a longitudinal tension a relative resistance to being stretched will steadily increase towards each outer edge to maintain strength at each outer edge, but to avoid a sharp transition at the boundaries in order to prevent crease formation that can cause a line artifact.

9. A method as recited in claim 8, wherein respective resistive elements that make contact with the edge areas adjacent the boundaries are heated slightly less than respective resistive elements that make contact with the dye transfer area adjacent the boundaries are heated to effect only a slight drop in heat across the boundaries from the dye transfer area to the edge areas in order to begin the gradual drop in heat.

10. A thermal printer capable of preventing crease formation in a dye transfer area of a dye donor web that can cause a line artifact to be printed on a dye receiver during a dye transfer from the dye transfer area to the dye receiver, said printer comprising:

a print head having a bead of selectively heated resistive elements that make contact across the dye transfer area of the dye donor web and opposite edge areas of the dye donor web that are alongside the dye transfer area as the dye transfer area and the edge areas are progressively advanced under a longitudinal tension over the bead of resistive elements; and a control adapted to selectively heat those resistive elements that make contact with the dye transfer area to effect a dye transfer from the dye transfer area to a dye receiver, and adapted to variably heat those resistive elements that make contact with the edge areas alongside the dye transfer area to effect a gradual drop in heat substantially from respective boundaries between the dye transfer area and the edge areas to an outer edge of each edge area that is spaced from the dye transfer area, whereby when the heated transfer area and edge areas are subjected to a longitudinal tension a relative resistance to being stretched will steadily increase towards each outer edge to maintain strength at each outer edge, but to avoid a sharp transition at the boundaries in order to prevent crease formation that can cause a line artifact.

11. A thermal printer as recited in claim 10, wherein said control is adapted to heat respective resistive elements that makes contact with the edge areas adjacent the boundaries slightly less than respective resistive elements that make contact with the dye transfer area adjacent the boundaries are heated to effect only a slight drop in heat across the boundaries from the dye transfer area to the edge areas in order to begin the gradual drop in heat.

12. A thermal printer capable of preventing crease formation in a dye transfer area of a dye donor web that can cause a line artifact to be printed on a dye receiver during a dye transfer from the dye transfer area to the dye receiver, said printer comprising:

means for heating the dye transfer area of the dye donor web to effect a dye transfer from the dye transfer area to a dye receiver; and means for heating opposite edge areas of the dye donor web that are alongside the dye transfer area, but with a gradual drop in heat substantially from respective boundaries between the dye transfer area and the edge areas to an outer edge of each edge area that is spaced from the dye transfer area, so that when the heated transfer area and edge areas are subjected to a longitudinal tension a relative resistance to being stretched will steadily increase towards each outer edge to maintain strength at each outer edge, but to avoid a sharp transition at the boundaries in order to prevent crease formation that can cause a line artifact.

* * * * *